United States Patent [19]

Swift

[11] 4,037,573

[45] July 26, 1977

[54] TIMING CONTROL FOR FUEL INJECTION PUMP

[75] Inventor: Joseph Edward Swift, South Windsor, Conn.

[73] Assignee: Stanadyne, Inc., Windsor, Conn.

[21] Appl. No.: 688,828

[22] Filed: May 21, 1976

[51] Int. Cl.[2] ..... F02M 59/20

[52] U.S. Cl. ..... 123/139 AQ; 123/139 ST; 123/179 L; 417/221

[58] Field of Search ..... 123/139 AM, 139 BD, 123/139 AP, 139 AQ, 140 FG; 417/218, 221, 462

[56] References Cited

U.S. PATENT DOCUMENTS

| | | | |
|---|---|---|---|
| 3,147,746 | 9/1964 | Hofer | 123/139 AQ |
| 3,433,159 | 3/1969 | Kemp | 123/139 AQ X |
| 3,486,492 | 12/1969 | Lehnerer | 123/139 AQ |
| 3,897,764 | 8/1975 | Bakti | 123/139 AQ |

*Primary Examiner*—Carroll B. Dority, Jr.
*Assistant Examiner*—Tony M. Argenbright
*Attorney, Agent, or Firm*—Prutzman, Hayes, Kalb & Chilton

[57] ABSTRACT

A fuel injection pump having a cam and pump plungers movable relative to the cam to translate the contour of the cam into a sequence of pumping strokes is disclosed. An advance piston connected to the cam to adjust the timing of the pumping strokes is controlled by a hydraulic pressure which increases with engine speed. The advance piston mounts two control pistons one of which controls the delivery of hydraulic pressure to the advance piston after a predetermined engine speed is reached and the other bypasses the first to control the delivery of the hydraulic pressure during starting and until a lower engine speed is reached.

8 Claims, 2 Drawing Figures

FIG. 1
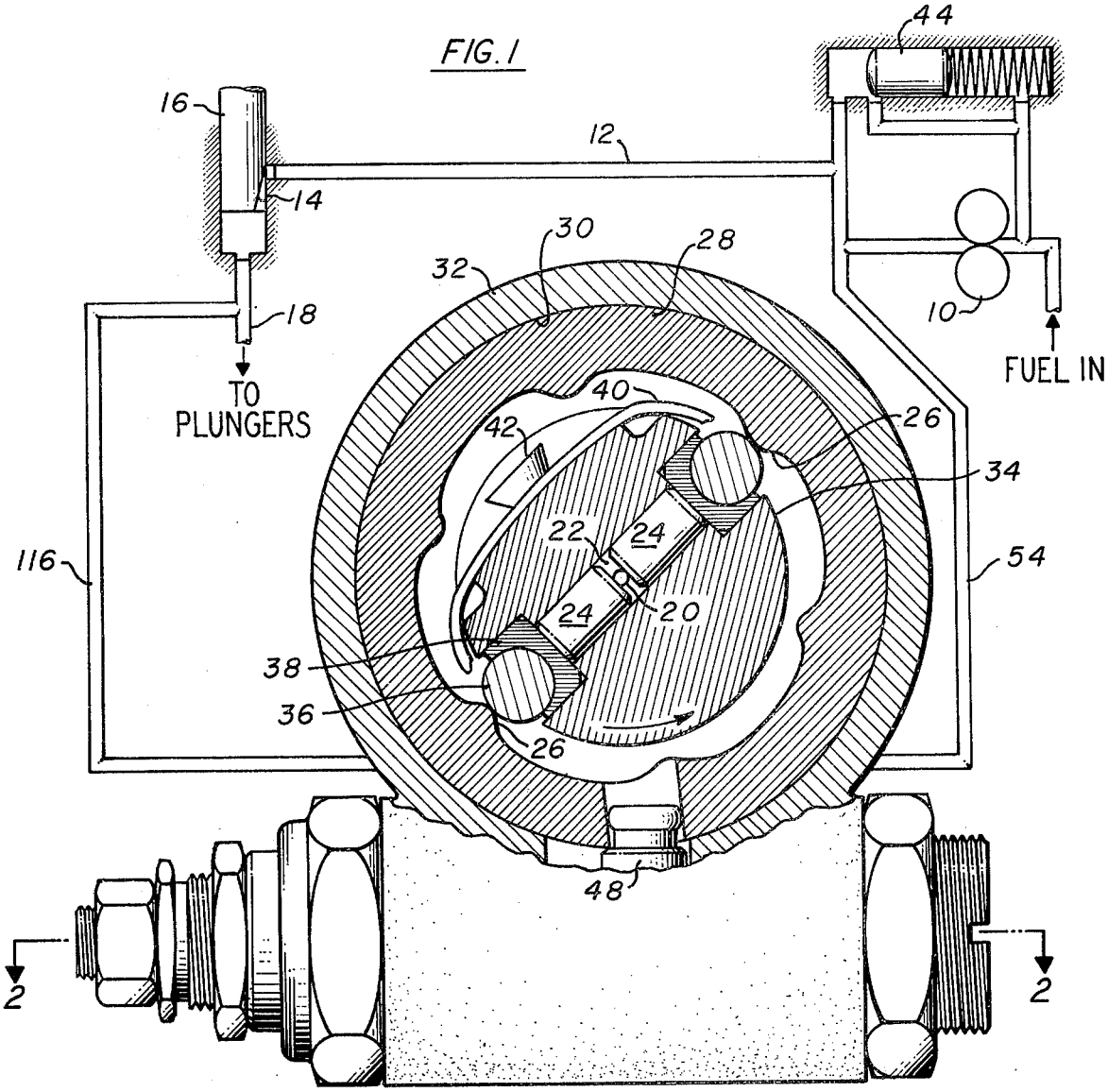
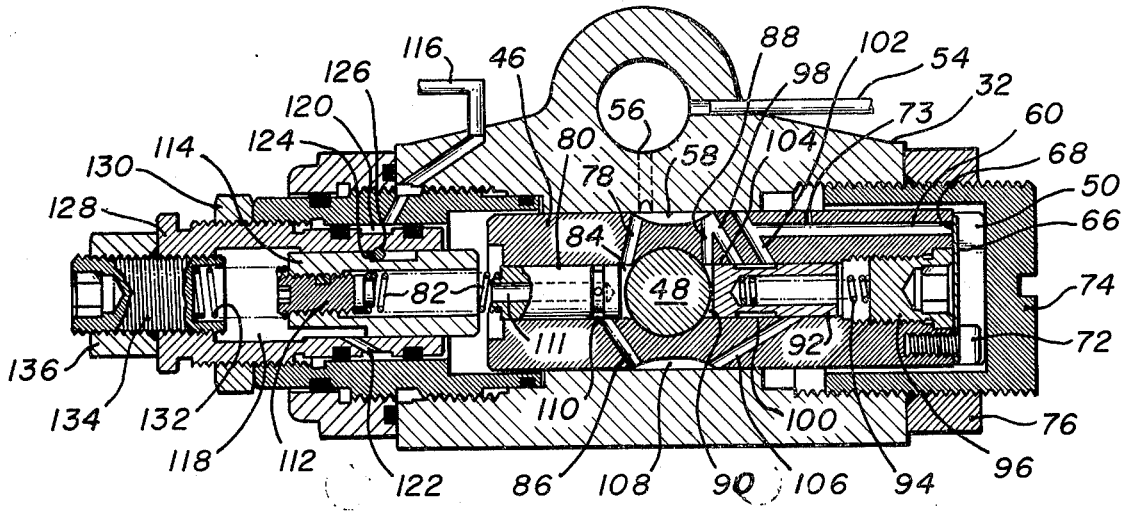
FIG. 2

TIMING CONTROL FOR FUEL INJECTION PUMP

This invention relates to liquid fuel injection pumps for internal combustion engines and more particularly to an improvement in such fuel pumps for automatically controlling the timing of fuel injection by the pump.

Fuel injection pumps of the type referred to above deliver metered charges of liquid fuel under high pressure in sequence to the several cylinders of an associated engine in timed relation therewith. A cam ring of the pump having inwardly directed cam lobes surround one or more rotor mounted pumping plungers which produce the high pressure charges of fuel so as to move the pump plungers bodily relatively to the cam to translate the configuration of the cam lobes to the desired timed pumping strokes.

In order to increase the efficiency and smoothness of operation of the engine, it is frequently the practice to advance the timing of injection of fuel to the cylinders at increased engine speeds. This may be accomplished by adjusting the angular position of the cam which is mounted for limited angular movement and is restrained from rotating by an advance piston and a connecting pin.

In certain types of engines, it has also been found desirable to advance the timing a certain amount during the starting of the engine.

It is the primary object of the invention to provide an improved timing means for a fuel injection pump which advances the timing of the pump during starting to facilitate the starting of the engine associated with the pump.

It is a further object of the invention to provide a new and novel injection timing means which provides an advance in the timing of injection during starting and then automatically retards timing after the engine starts and reaches a predetermined speed.

Other objects will be in part obvious and in part pointed out more in detail hereinafter.

A better understanding of the invention will be obtained from the following detailed description and the accompanying drawing of an illustrative application of the invention.

In the drawing:

FIG. 1 is an end elevation view, partially in section and partly schematic, of a fuel pump incorporating the invention; and FIG. 2 is a cross-sectional view taken along line 2—2 of FIG. 1.

Referring now to the drawing in detail, there is illustrated a fuel pump suitable for the practice of the present invention. Such a pump is similar to that disclosed and claimed in U.S. Pat. No. 3,771,506 which issued Nov. 13, 1973.

As shown, fuel under pressure is delivered from the output of the transfer pump 10 to a passage 12 for delivery to a metering valve passage 14 wherein a metering valve 16 provides a variable restriction to control the flow of fuel delivered by passage 18 which is connected by rotor passage 20 to pump chamber 22 of the high pressure pump shown as comprising a pair of reciprocable pump plungers 24 which are simultaneously urged inwardly by cam lobes 26 of a cam ring 28 which is mounted for limited angular movement in a bore 30 of the pump housing 32.

As is now well known in the art, rotor passage 20 sequentially registers with passage 18 as the rotor 34 rotates when the pump plungers 24 are free to move outwardly to charge the pump chamber 22 with a charge of fuel the amount of which is determined by the setting of the metering valve. Continued rotation of the rotor 34 interrupts the connumication between the rotor passage 20 and the passage 18 when as shown in FIG. 1, the cam rollers 36 engage the cam lobes 26 and act through roller shoes 38 to force the plungers 24 inwardly to pressurize the fuel contained in pump chamber 22 to high pressure. The high pressure fuel in the pump chamber 22 is delivered by the passage 20 to a series of passages, not shown, positioned around the distributor rotor 34 for sequential registry with the passage 20 in a wellknown manner to deliver the charges of fuel from the pump chamber 22 sequentially to the several cylinders of the associated engine.

The maximum outward radial movement of the shoes 38 is limited by the ends of the leaf spring 40 adjustably mounted by a screw 42.

A spring biased pressure regulating valve 44 is provided to control the output pressure from the transfer pump 10 so that it varies with the speed of the engine driving the fuel pump.

To vary the timing of injection of the fuel into the associated cylinders of the engine, the cam ring 28 is rotated to adjust the angular position of the cam lobes 26 and is maintained in its adjusted position by piston 46 of the automatic advance mechanism and a connecting pin 48.

As shown in the drawing, a closed power chamber 50 is formed at one end of the cylinder in which piston 46 is slidably mounted and receives liquid fuel through the passage 54, connected to the outlet of the tranfer pump 10, passage 56, slot 58 and axial passage 60 as hereinafter described. A flat annular valve 66 overlies port 68 in the wall of chamber 50 and is mounted by means of a pair of mounting screws 72 (only one of which is shown) to provide a flat ring seal for accommodating one-way flow of fuel into the chamber 50. High impact pulses of pressure produced on the rollers 36 when riding over the cam lobes 26 automatically seats the valve 66 to trap the fuel in the chamber 50 and to prevent reverse flow in passage 54.

A bleed orifice 73, as well as leakage past advance piston 46, allows for the gradual bleeding of fuel from chamber 50 as the amount of fuel in chamber 50 decreases to allow the piston 46 to assume a new position of equilibrium at lower engine speed.

As shown, chamber 50 is formed in a cap sleeve 74 threaded into the pump housing 32 to adjustably set the maximum retard position of piston 46 when bottomed against the cap sleeve 74 and is held in adjusted position by lock nut 76.

So far as the structure of the cam and the adjusting mechanism just described are concerned, these are similar to those described in prior U.S. Pat. No. 3,771,506.

For adjusting the axial position of advance piston 46 to control the timing of injection, the output of transfer pump 10 is fed through passages 54 and 56 and slot 58 in the advance piston, which is in continuous communication with passage 56, to a chamber 84 where it is impressed on the end of servo piston 80 against the bias of a biasing spring 82.

When the engine is being cranked for starting, advance piston 46 is moved to the right so that it is bottomed, as shown in FIG. 2, against the cap sleeve 74 due to the reaction forces between the cam lobes 26 and the rollers 36. The output pressure from the transfer pump is low at cranking speeds and is insufficient to move servo piston 80 to the left against the opposing force of biasing spring 82. This prevents communication between chamber 84 and passage 86 which delivers fuel to the power chamber 50 during the normal operation of the advance mechanism.

It will be noted that slot 58 also communicates with passage 88 to deliver transfer pump output pressure to chamber 90 and apply a force tending to urge starting advance servo piston 92 to the right against the bias of a spring 94. The preload on spring 94 is sufficient, however, to prevent the movement of starting advance servo piston 92 until a predetermined engine speed, say, 800 r.p.m., is reached. Spring seat 96 is adjustable to set this speed. A third passage 98 communicates with slot 58 during cranking and delivers fuel to an annulus 100 around starting advance servo piston 92 which in turn communicates with axial passage 60 through diagonal passage 102 to deliver the output from transfer pump 10 to the power chamber 50 at cranking speeds, thereby to move the advance piston 46 to the left and advance cam 28 through connecting pin 48.

After the engine starts and transfer pump pressure increases further, the pressure in chamber 90 increases to overcome the biasing force of spring 94 until the starting advance servo piston 92 is bottomed against spring seat 96 where it remains until the engine is stopped.

When starting advance servo piston is so bottomed, the land 104 thereof cuts off cummunication between passage 98 and annulus 100 so that the output of transfer pump 10 is no longer delivered therethrough to power chamber 50. At the same time, annulus 100 uncovers passage 106 to provide communication between passage 106 and passage 102 to bleed the trapped fuel in power cavity 50 through orifice 73, passage 106, slot 108, passage 86, and annulus 110 which communicates with chamber 111 in which the pressure is low housing pressure. This allows advance piston 46 to move to its full retard position under the injection forces being applied to the cam 28.

With starting advance servo piston 92 bottomed against spring seat 96, the engine stays at full retard position until the pressure in chamber 84 applied to the end of servo piston 80 becomes high engough at say, 1000 r.p.m., to overcome the biasing force of a spring 82. As servo piston 80 moves to the left, it uncovers passage 86 to provide communication between chamber 84 and passage 86 to admit fuel under transfer pump output pressure to passage 86 from whence it is fed to slot 108, passage 106, annulus 100, and passages 102 and 60 to the power chamber 50. The advance piston 46 then moves to the left as the amount of fuel in chamber 50 increases, and moves relative to servo piston 80 to interrupt communication between chamber 84 and passage 86 when equilibrium is reached. Servo piston 80 continues to control the presence or absence of communication between chamber 84 and passage 86 to control the volume of fuel in power chamber 50 in accordance with engine speed during the operation of the engine.

If desired and as illustrated, the advance mechanism may include means for modifying the amount of advance according to load.

In the illustrated embodiment, the spring seat 112 for biasing spring 82 of servo piston 80 is shown as being mounted on an axially movable load sensing piston 114 with spring seat 112 being threadably adjusted thereto to set the preload of the spring 82. Accordingly, the longitudinal position of spring seat 112 is movable along with the biasing forces acting on load sensing piston 114.

As shown, fuel downstream of the metering valve 16 is delivered by passage 116 to a chamber 118 at one end of the load sensing piston 114 via annulus 120 and diagonal passage 122. If the metering valve is in wide open position, the pressure in passage 116 downstream of the metering valve 16 and in chamber 118 is essentially the same as the transfer pump pressure acting in chamber 84 on the end of servo piston 80. Since the diameter of load sensing piston 114 is greater than that of servo piston 80, the shoulder 124 of load sensing 114 will be held against stop 126 as indicated in FIG. 2.

When engine speed increases sufficiently to overcome the biasing force of spring 82, the servo piston 80 moves to the left to make mechanical contact with the load sensing piston 114. This limits any further movement of the servo piston and represents the limit of full load advance.

If the metering valve is moved to increase the restriction offered at metering orifice 14 to reduce the amount of fuel delivered to the engine, a drop in pressure occures in passage 116 and chamber 118 so that load sensing piston 114 will be moved to the left under the bias of spring 82 which transmits the transfer pump pressure in chamber 84 to the load sensing piston. This allows the servo piston 80 to move further to the left permitting additional movement of advance piston 46 in response to a decrease in engine load, thereby providing a greater advance in timing under part load operation than under full load operation.

As shown in FIG. 2, the sleeve 128 forming the cylinder for load sensing piston 114 is axially adjustable to adjust the amount of full load advance and lock nut 130 is provided to maintain the sleeve in adjusted position. Also, as shown, a spring 132 having a low spring rate is provided to assist the metered fuel pressure in chamber 118 in biasing load sensing piston 114 to the right. The amount of preload on this spring may be adjusted by adjusting screw 134 which is maintained in adjusted position by lock nut 136 and this spring determines the metering valve setting at which the advance in timing increases for part load operation from the timing established for full load operation.

A high preload on spring 132 delays the start of advance in timing for part load beyond that for a full load setting.

As will be apparent to persons skilled in the art, various modifications, adaptations and variations can be made from the foregoing specific disclosure without departing from the teachings of the present invention.

I claim:

1. In a fuel injection pump for an internal combustion engine, pump plunger means providing sequential pumping strokes, means for changing the timing of the pumping strokes comprising a cylinder, an advance piston movable in said cylinder, means interconnecting said advance piston with said pump plunger means to advance and to retard the relative timing of the pumping strokes, a source of fluid having a pressure correlated with engine speed providing a speed related pressure, a hydraulic chamber at one end of said piston connected to said source of fluid under pressure to move the advance piston to advance the timing of the pumping strokes in response to increased engine speed, first means for controlling the delivery of fluid from said source to said hydraulic chamber, said first means including means for preventing the delivery of fluid from said source to said hydraulic chamber until a predetermined speed is reached, and second means for controlling the delivery of fluid from said source to said hydraulic chamber, said second means bypassing said first means to deliver fluid from said source to said hydraulic chamber during the starting of the engine thereby to advance the timing of the pumping strokes.

2. The combination of claim 1 including means for rendering said second control means inoperative to deliver fluid from said source to said hydraulic chamber at a second engine speed lower than said predetermined speed.

3. The combination of claim 2 including means for dumping the fluid from said hydraulic chamber after the engine reaches said second speed.

4. The combination of claim 1 wherein said second means is a piston which acts as a valve and is biased to open the valve during starting until said second speed is reached.

5. The combination of claim 4 wherein fluid from said source acts on said valve to close the valve at said second speed.

6. The combination of claim 5 wherein said valve is a piston mounted in a bore in said advance piston.

7. The combination of claim 1 including a movable load sensing piston, a source of fluid under a pressure correlated with the load on the engine, and a hydraulic chamber at one end of said load sensing piston connected to said load related source of fluid pressure, said load sensing piston being operatively connected to said advance piston to move the advance piston in the direction to retard the timing of said pumping stroke in response to increased engine load.

8. The combination of claim 7 wherein a stop is provided for limiting the movement of said load sensing piston in a direction to retard the timing of said pumping strokes whereby the load sensing piston is not effective to modify the timing of said pumping strokes when the load exceeds a predetermined amount.

* * * * *